US008827874B2

(12) United States Patent
Nishimura

(10) Patent No.: US 8,827,874 B2
(45) Date of Patent: Sep. 9, 2014

(54) ENHANCEMENT OF THE FLOOR OF A GYM'S WEIGHTROOM

(76) Inventor: Takashi Nishimura, São Paulo (BR)

( * ) Notice: Subject to any disclaimer, the term of this patent is extended or adjusted under 35 U.S.C. 154(b) by 425 days.

(21) Appl. No.: 13/262,138

(22) PCT Filed: Mar. 30, 2010

(86) PCT No.: PCT/BR2010/000113

§ 371 (c)(1),
(2), (4) Date: Dec. 30, 2011

(87) PCT Pub. No.: WO2010/111763

PCT Pub. Date: Oct. 7, 2010

(65) Prior Publication Data

US 2012/0094809 A1 Apr. 19, 2012

(30) Foreign Application Priority Data

Mar. 31, 2009 (BR) ..... 0900575

(51) Int. Cl.

| | |
|---|---|
| ***A63B 21/08*** | (2006.01) |
| ***A63B 21/06*** | (2006.01) |
| ***A63B 23/12*** | (2006.01) |
| ***A63B 23/04*** | (2006.01) |
| ***A63B 21/062*** | (2006.01) |
| *A63B 24/00* | (2006.01) |

(52) U.S. Cl.

CPC ..... *A63B 23/12* (2013.01); *A63B 24/0087* (2013.01); *A63B 2225/107* (2013.01); *A63B 23/0494* (2013.01); *A63B 21/062* (2013.01); *A63B 2021/0623* (2013.01)

USPC ..... 482/93; 482/97

(58) Field of Classification Search

CPC ..... A63B 21/062; A63B 23/1281; A63B 21/00181; A63B 21/1492; A63B 21/154; A63B 21/0615; A63B 21/068

USPC ..... 482/24, 37, 131, 95–102

See application file for complete search history.

(56) References Cited

U.S. PATENT DOCUMENTS

| | | | | |
|---|---|---|---|---|
| 3,834,695 | A * | 9/1974 | Boggild et al. | 482/33 |
| 4,257,592 | A * | 3/1981 | Jones | 482/131 |
| 4,619,462 | A * | 10/1986 | Shaffer et al. | 280/242.1 |
| 6,612,170 | B2 | 9/2003 | Brown | |
| 6,770,015 | B2 * | 8/2004 | Simonson | 482/99 |
| 8,088,050 | B2 * | 1/2012 | Aucamp | 482/131 |
| 2006/0178246 | A1 * | 8/2006 | Tjerrild | 482/24 |
| 2014/0005009 | A1 * | 1/2014 | Giannelli | 482/102 |

FOREIGN PATENT DOCUMENTS

KR 100757205 B1 9/2007

* cited by examiner

*Primary Examiner* — Stephen Crow
(74) *Attorney, Agent, or Firm* — Arent Fox LLP

(57) ABSTRACT

A floor of a gym's weight room is configured to encompass the installation of weight stations with weight towers controlled remotely from a control panel, with said weight station assembled atop a weight room floor. The floor of the gym, for each station-tower combination, includes two reinforced boxes embedded in the floor, each having an opening at floor level, wherein one box is located below the base of the weight station and one box is located in front of the respective weight tower, preferably positioned far from the station, the two boxes being connected by at least two parallel tubes located beneath the level of the gym's floor, and wherein the interior of each box is affixed with a cable pulley and bearing, each cable pulley being at a level so that the horizontal section of a steel cable runs toward a center of one of the tubes.

4 Claims, 5 Drawing Sheets

ENHANCEMENT OF THE FLOOR OF A GYM'S WEIGHTROOM

CROSS-REFERENCE TO RELATED APPLICATIONS

This application is the National Stage entry of international application No. PCT/BR2010/000113, filed Mar. 30, 2010, and claims the priority of Brazil Application No. PI0900575-7, filed Mar. 31, 2009, the entire specifications, claims and drawings of which are incorporated herein by reference.

BACKGROUND

1. Field

The present invention is directed to an enhancement of the floor of a weight room in a gym and, more specifically, to a structural and assembly concept for gym floors, and specifically for the weight room floor, to enable the optimal use of space to set up weight stations.

2. Introduction

As those skilled in the art are aware, a gym's weight room, which is equipped with stations that use levers, pedals and other devices to exercise users' muscle groups, as well as respective towers that include stacks of varying individual weights, are generally congested on account of the presence and need for a tower for each weight station.

Placement of towers outside the weight station areas is desirable but requires an electromechanical mechanism to select the weight for each tower, with a control panel within the user's reach. The tower and the weight station may be connected by a solid tube housing a steel cable, which devices on the weight station move by traction and through which pulleys pass to reach the top of the tower, where cables run back to the lower part and affix to a buckle that holds up the weights.

The objective of this invention is to separate the towers from their respective weight stations without jeopardizing the evenness of the weight room floor.

Another objective of this invention is to enhance a gym's weight room to make assembly of the weight stations in the gym easier, without generating congestion through the accumulation of weight stations and their respective towers.

Another objective of this invention is to enhance a gym's weight room floor so as to allow a distancing of the towers, wherein, for example, the towers may be located in profile along one wall of the weight room while the weight stations are placed throughout the room, leaving the floor level and uniform.

SUMMARY

These and other objectives and advantages of this invention are attained with the enhancement of the floor of a gym's weight room, which includes the assembly of weight stations with towers that are activated via remote control from a control panel at each weight station, with said weight station placed on the floor of the weight room or the assembly of the gym prepared to receive installation of such. According to the invention, for each station-tower, the gym floor is equipped with two reinforced boxes, embedded in the floor, that contain an opening at floor level, one box being located below the base of the weight station and one in front of the tower, wherein the two boxes may be connected by at least two tubes located beneath the gym's floor level. The interior of each box is affixed with a cable pulley and bearing, and each pulley runs the horizontal section of the steel cable toward the center of one of the tubes, with one of the pulleys directing the steel cable to the pulley at the top of the tower while the other pulley runs the same cable to the weight station pulley. The other tube, which may be parallel to the tube handling the cable, encloses the electrical wires that run from the control panel at the weight station to the tower. Should a weight station be inoperative or not be installed, the boxes are closed with covers that are flush with the level of the floor finishing.

It is understood that other aspects of the invention will become readily apparent to those skilled in the art from the following detailed description, wherein various aspects of the present invention are shown and described by way of illustration only. As will be understood, the present invention is capable of other and different variations and its several details are capable of modification in various other respects, all without departing from the scope of the invention. Accordingly, the drawings and detailed description are to be regarded as illustrative in nature and not as restrictive.

BRIEF DESCRIPTION OF THE DRAWINGS

The accompanying drawings, which are incorporated in and constitute a part of this specification, illustrate various example implementations consistent with aspects of the invention, and, together with the description, serve to explain the principles thereof.

DETAILED DESCRIPTION

Figure 1:
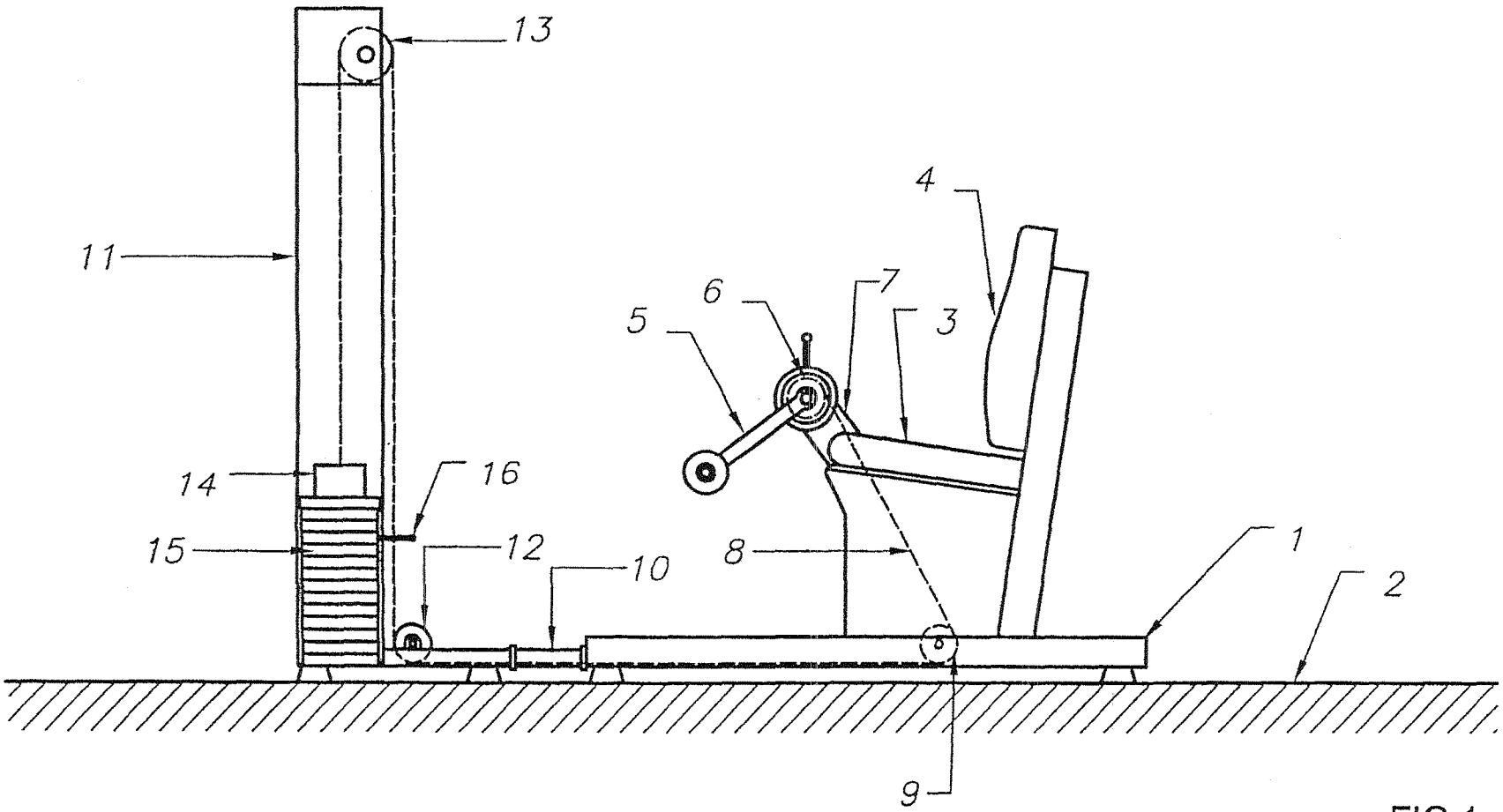
FIG. 1 depicts a side view of a conventional weight station apparatus with its connected tower.

As shown in the figures, an enhancement of the floor of a gym's weight room may include a weight station that conventionally consists of one base 1 that rests on the gym floor 2 and includes a seat 3, back 4 and lever 5, which is moved by the user rotating a pulley 6 in the structure 7 of the station, the pulley 6 being coupled to an outgoing steel cable 8. The steel cable 8 passes through a pulley 9 on the base 1, runs horizontally, exits the base 1 and passes through an element 10 that connects to the weight tower 11. The cable 8 may then be diverted to the top of the weight tower 11 via a pulley 12 and, from atop the tower, runs downward via a pulley 13 to couple with a center of a buckle 14 that secures the weights 15. The pin of the buckle 14 slides into the central holes of the weights, which contain couplings at the level of each weight so that a retention pin 16 can be inserted into the chosen weight, as shown in FIG. 1.

The conventional construction of FIG. 1 does not allow for much distancing of the weight station's tower 11. This limitation is due to the need to have some connecting element 10 between the weight station and the tower that protects the steel cable and that reacts to the horizontal traction force of the cable. This limitation is also due to the need for the user to be able to reach the pin 16 for selecting the weights, which are stacked in the tower.

With the advent of electomechanical means to select weights affixed to the towers and control panels on the weight stations, it becomes possible to distance the weight station from the weight tower since the user no longer needs to reach the weight pin 16.

Aspects of the present invention drastically distance the towers from the weight stations, allowing the towers to be located in profile along one wall of the weight room, for example, while the weight stations are placed throughout the room, leaving the floor level and uniform.

Aspects of the present invention may require a renovation of the weight room floor or assembly of the gym in such a way that anticipates installation of the invention.

Figure 2:
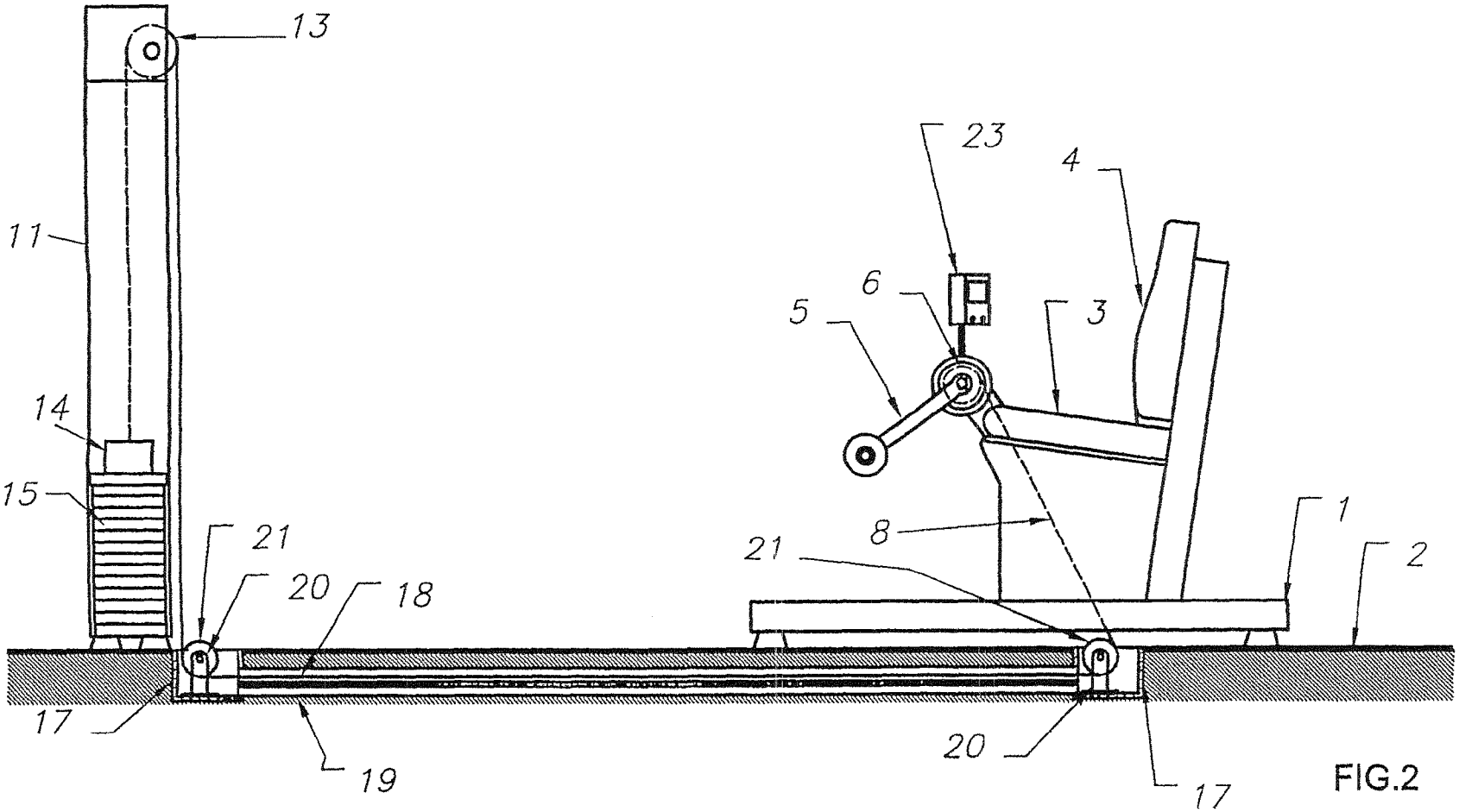
FIG. 2 is a vertical cut-away view of the enhanced floor, with a remote tower and its weight station, in accordance with some aspects of the present invention.
Figure 3:
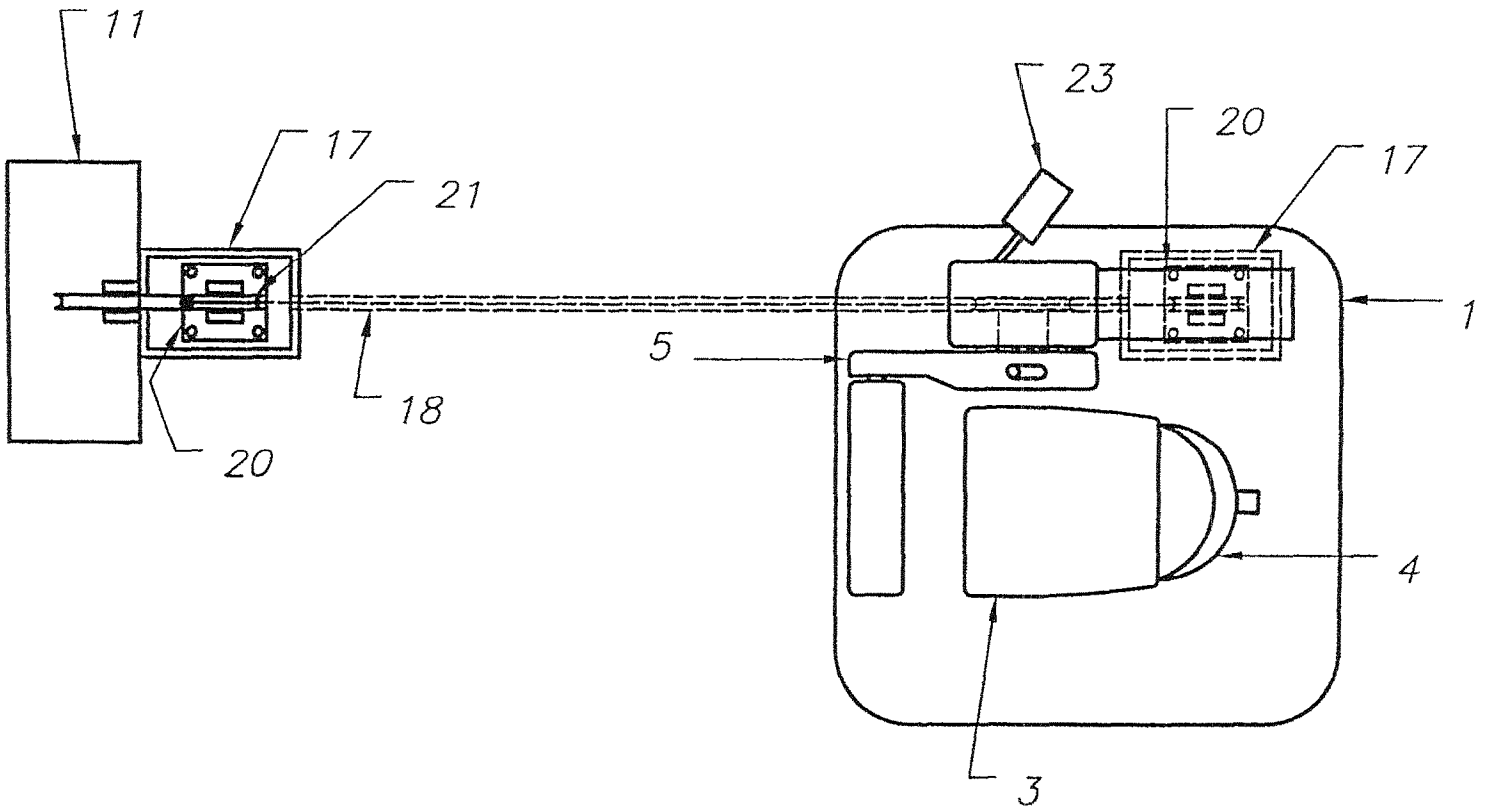
FIG. 3 is a horizontal view of the apparatus of the remote tower and the weight station that appears in FIG. 2, in accordance with some aspects of the present invention.

As shown in FIGS. 2 and 3, for each tower-weight station combination, the gym floor 2 is equipped with two reinforced boxes 17 that are embedded in the floor 2, each box configured with an opening at floor level. One box may be located below the base 1 of the weight station and one box may be located in front of the tower 11, with the two boxes connected by at least two tubes 18 and 19 located beneath the level of the gym's floor 2. The interior of each box 17 is affixed with a cable pulley 21 and bearing 20, and each pulley is located at a level that runs to extend the horizontal section of the steel cable 8 toward the center of one of the tubes 18. The pulley 21 runs the steel cable 8 to the pulley 13 at the top of the tower 11 while the other pulley 21 runs the same cable 8 to the weight station pulley 6.

The other tube 19 encloses the electrical wires that run from the control panel 23 at the weight station to the tower 11.

Figure 4:
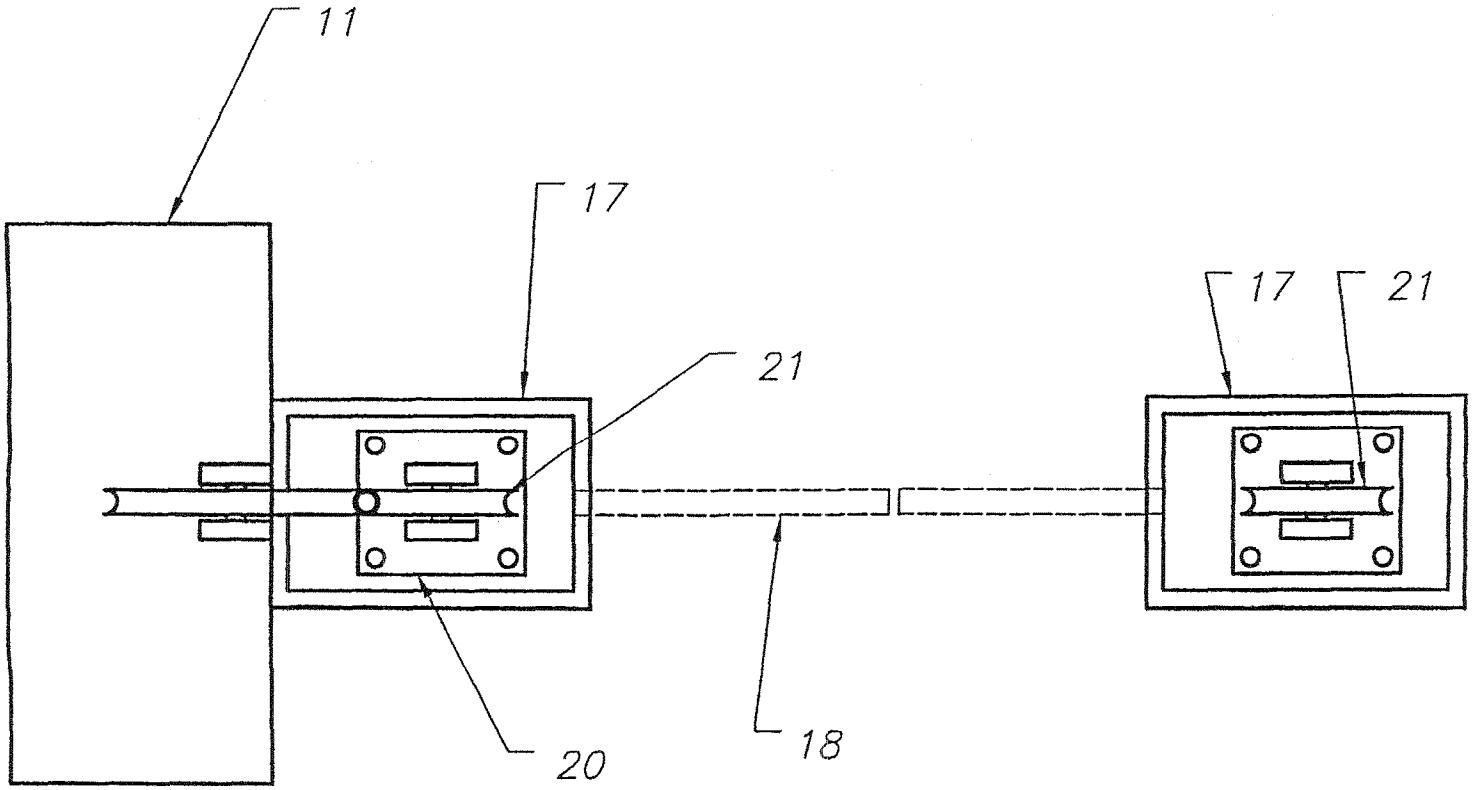
FIG. 4 is a magnified horizontal view of the enhanced floor with a tower, in accordance with some aspects of the present invention.

FIG. 4 shows a tower 11, assembled in front of its box 17, and the opposing box, without the weight station.

Figure 5:
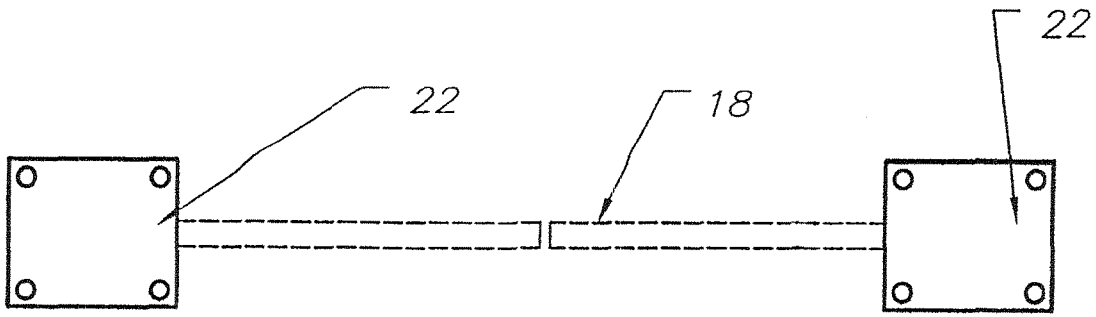
FIG. 5 is a top view of the enhanced floor without a tower and without the station with closed embedded boxes, in accordance with some aspects of the present invention.

FIG. 5 shows a top view of the floor and illustrates the boxes 17 that are not being used and, thus, are closed with covers 22 that are plush with the floor 2 finishing. Nevertheless, these boxes 17 are equipped to receive new equipment in the future, with the boxes closed with lids 22 that need only to be removed to install the passing mechanical cables and electrical wires.

The equipment, towers and stations can be removed for maintenance without jeopardizing the even continuity of the floor.

The tubes 18 and 19, which are located below the gym's floor 2 level, provide a solution as to the level continuity of the floor 2 since the tubes 18 and 19 do not have to be parallel to the floor 2; and in order to compensate for this, the invention may include, at least, a bearing 20 and pulley 21 set placed along said tubes 18 and 19.

While the present invention has been described in connection with preferred aspects, it will be understood by those skilled in the art that variations and modifications of the preferred aspects described above may be made without departing from the scope of the invention. Other aspects will be apparent to those skilled in the art from a consideration of the specification or from a practice of the invention disclosed herein.

The invention claimed is:

1. An assembly for installation into a floor for coupling at least one weight station with at least one weight tower that is controlled remotely from a control panel, the assembly comprising:

two reinforced boxes embedded in the floor, each box having an opening at floor level, wherein one box is located below a base of the weight station and one box located in front of the weight tower;

at least two tubes located beneath the level of the floor connecting the two boxes, a cable pulley and bearing set affixed in an interior of each of the two boxes; and a cable, wherein each cable pulley is at a level that runs a horizontal section of the cable toward a center of one of the two tubes with one of the cable pulleys running the cable to an upper pulley at a top of the weight tower and the other cable pulley running the cable to a weight station pulley; and wherein the other one of the two tubes runs parallel to the first one of the two tubes and encloses the electrical wires that run from the control panel at the weight station to the weight tower.

2. The assembly for installation into a floor according to claim 1, wherein the two tubes located below the floor level are parallel to the floor.

3. The assembly for installation into a floor according to claim 1, wherein the two tubes located below the level of the floor are not parallel to the floor; the assembly further comprising a third cable pulley and bearing set placed along the two tubes.

4. The assembly for installation into a floor according to claim 1, wherein when a weight station is inoperative or not installed, the boxes embedded in the floor remain closed with covers substantially flush with the floor level.

* * * * *